United States Patent [19]

Biehl et al.

[11] Patent Number: 4,870,378

[45] Date of Patent: Sep. 26, 1989

[54] ELECTROMAGNETIC RELAY AND METHOD FOR ITS MANUFACTURE

[75] Inventors: Wilfried Biehl; Horst Hendel; Florenz Von Guttenberg, all of Berlin, Fed. Rep. of Germany

[73] Assignee: Siemens Aktiengesellschaft, Berlin and Munich, Fed. Rep. of Germany

[21] Appl. No.: 152,363

[22] Filed: Feb. 4, 1988

[30] Foreign Application Priority Data

Feb. 13, 1987 [DE] Fed. Rep. of Germany ..... 3704621

[51] Int. Cl.[4] ..... H01H 67/02

[52] U.S. Cl. ..... 335/128; 335/80

[58] Field of Search ..... 335/78–85, 335/128; 324/415, 418, 421

[56] References Cited

U.S. PATENT DOCUMENTS 4,267,540 5/1981 Iketani ..... 335/128

4,701,734 10/1987 Nakano et al. ..... 335/128

FOREIGN PATENT DOCUMENTS

A0011952 6/1980 European Pat. Off. .

1862118 11/1962 Fed. Rep. of Germany .

8235283 12/1982 Fed. Rep. of Germany .

OTHER PUBLICATIONS

Publication from the Technical Digest, No. 44, Oct. 1976, pp. 25–26.

*Primary Examiner*—C. L. Albritton

*Assistant Examiner*—Lincoln Donovan

*Attorney, Agent, or Firm*—Hill, Van Santen, Steadman & Simpson

[57] ABSTRACT

An electromagnetic relay includes an elevated measuring point provided on an armature, the measuring point being applied to a rivet which fastens the contact spring to the armature. A flat sensor contacts the elevated measuring point to undertake precise measurement of the force-path characteristic of the armature. A method for manufacturing the relay is also provided.

9 Claims, 1 Drawing Sheet

ELECTROMAGNETIC RELAY AND METHOD FOR ITS MANUFACTURE

BACKGROUND OF THE INVENTION

1. Field of the Invention

The present invention is related generally to an electromagnetic relay and method for manufacture, wherein the relay includes a coil, an angled yoke having first leg coupled to an end of the coil core and a second leg forming a bearing edge for a flat armature which forms a working air gap with an opposite end of the coil core, as well as a contact spring interacting with at least one cooperating contact element coupled to the armature.

2. Description of the Related Art

A relay is disclosed in German Utility Model 82 35 283 having a contact spring secured to an armature where the contact spring also serves the purpose of bearing the armature and restoring it to a quiescent position. A significant quality feature of the relay is that the force path characteristic of the armature when attracting lies in a prescribed region. To measure the force path characteristic during manufacturing, it is standard to press a measuring sensor against the armature and thereby measure the curve of the force. However, to obtain comparable values of the force measurement, the measuring sensor must always contact the armatures at the same predetermined distance from the bearing location.

Force measuring sensors having a probe tip have hitherto been used to measure the force characteristic of armatures. The probe tip contacts the surface of either the contact spring or of the armature, or possibly the flat surface of a rivet button. It is required that the measuring sensor's probe tip be extremely accurately positioned relative to the armature seat. In large scale industrial manufacturing, this is only possible at considerable expense and outlay.

SUMMARY OF THE INVENTION

An object of the present invention is to provide a relay with which a precise sensing of the armature force is possible in a simple way and without involved positioning procedures of the sensor or relay.

It is a further object of the present invention to provide a method for manufacturing such a relay in an optimally simple way.

These and other objects are inventively achieved by providing an outside surface of the armature facing away from the coil core with a projection having a surface tapering in punctiform fashion, the tapered surface having an elevated most location forming a measuring point lying at a prescribed distance from the bearing edge of the armature.

In the relay of the invention, thus, a measuring point is structurally provided in the relay itself. A measuring point has the proper distance from the bearing location at the very outset and is, thus, necessarily contacted during the force sensing procedures. Furthermore, a measuring sensor having a pointed end is no longer required for sensing the present relay. By contrast, a measuring sensor having a flat end can be used, and its position relative to the armature does not enter into the measured result. Therefore, the positioning of the measuring sensor does not require high precision. A simple measuring step can be used in this way to quickly and reliably identify whether the force path curve of the armature lies in the required region, particularly during the manufacturing of relays on a large scale.

DESCRIPTION OF THE PREFERRED EMBODIMENTS

Figure 1:
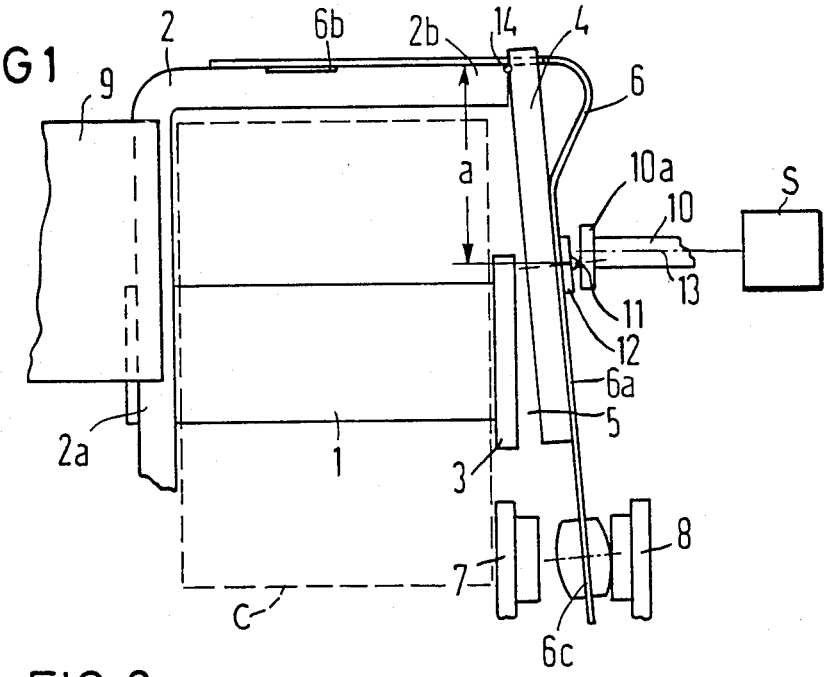
FIG. 1 is a partial side elevational view of an electromagnetic relay having a measuring point applied to an armature in accordance with the principles of the present invention.

In FIG. 1 is shown an electromagnetic relay. Only critical elements of the magnetic circuit and the contact system are shown, and selected details such as the coil, base member and the like are not shown in detail or are omitted for purposes of simplicity. Insofar as additional details are required for understanding the present relay, such details may be derived, for instance, from the disclosure of German Utility Model 82 35 383.

The relay of FIG. 1 has a coil core 1 with a first end coupled to a first leg 2*a* of an angle yoke 2. A coil C shown in dotted outline is wound about the coil core 1 and a pole plate 3 is provided at a second end of the coil core 1. A flat armature 4 is seated at the free end or first leg 2*a* of the yoke 2 so that the armature 4 forms a working airgap 5 with the pole plate 3. An essentially angular contact spring 6 having a first leg 6*a* secured to an outside of the armature 4 is provided, whereas a second leg 6*b* is secured to the yoke 2 and, thus, simultaneously serves to hold and reset the armature 4. The contact spring 6 has a free end 6*c* switchable between two cooperating contact elements 7 and 8. Such structure is known in the art.

To be able to measure the force path curve of the armature during manufacturing, the relay is held with a fastening fixture 9 while a measuring probe 10 of a sensor S presses against the armature 4. The measuring probe 10 has a flat end 10*a* which is pressed against a raised measuring point 11 that is formed on a rivet button 12 of the armature 4. Expediently, the rivet button 12 also serves to fasten the contact spring leg 6*a* to the armature 4. The raised measuring point 11 is only shown schematically in FIG. 1. The measuring point 11 can be formed in a variety of shapes, including a punctiform shape, either on the rivet 12 or on some other projection on the armature 4. The only matter of concern is that the highest point of the measuring point 11 have a proper predetermined distance a from a bearing axis 14 of the armature 4. An axial offset of the measuring probe 10 with its longitudinal axis 13 relative to the measuring point 11 thereby plays no part as long as the probe 10 of the measuring sensor S somehow contacts the measuring point 11 with its flat end 10*a*. In other words, the sensor 10 can be laterally offset relative to the relay without changing the measured value. The scattered or randomly variable position of the relay in the fastening fixture relative to the measuring sensor probe 10 is accommodated only by the flat end of the probe 10.

The shape of the measuring point 11 is arbitrary; for example, the measuring point 11 can taper to a point or be rounded off in the form of a half-shell or hemisphere.

Figure 2:
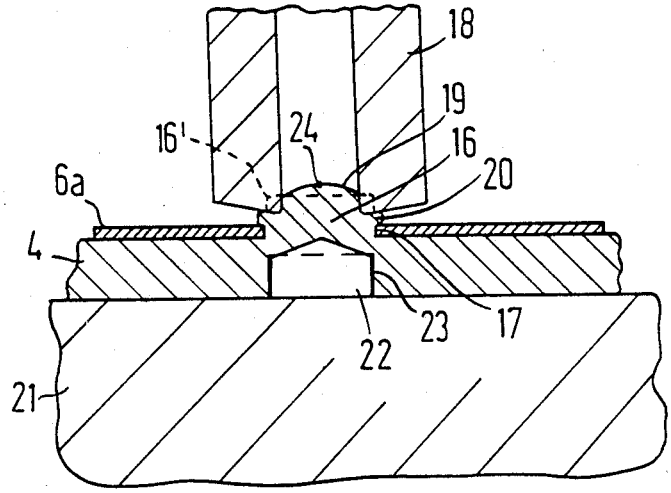
FIG. 2 is an enlarged fragmentary cross section of the armature from the relay of FIG. 1 including a coining tool for manufacturing the measuring point.

A simple manufacturing method for a measuring point in accordance with the principles of the present invention is described briefly with reference to FIG. 2. In the enlarged detail of FIG. 2 is shown an armature 4 from FIG. 1 on which the spring section 6a rests. An upwardly projecting rivet peg 16 onto which a recess 17 of the spring 6 is plugged is coined from the armature 4 into the shape or contour 16' (shown in broken outline).

The contour 16' of the rivet peg 16 is then deformed with a riveting tool 18 proceeding from above. A central rivet button 19 having a half-shell or hemispherical shaped surface is formed, which is surrounded by an annular rivet bead 20. A most elevated point 24 forms the measuring point 11. To form this portion, a bed tool 21 is provided with a centering and coining peg 22 which extends into a coining recess 23 of the armature 4. The riveting tool 18 then moves against the peg 16 to form the raised point 24 and the bead 20.

A central, half-shell shaped surface of the rivet button 19 can also be applied to the rivet peg 16 during manufacture of the armature 4. In this case, the riveting die 18 would only have to undertake an annular deformation to produce the rivet bead 20.

As a result of this type of coining in which a rivet peg 16 is deformed into a central part comprising a salient measuring point 24 and an annular rivet bead 20, a firm riveted seat for stress-free holding of the spring 6a having a form fit is provided, on the one hand. On the other hand, the elevated measuring point 11 or 24 is obtained having the advantages as set forth above without additional work steps.

Thus, it is possible to undertake precise measurement of the force path characteristic of an armature of a relay without the outlay and expense required in accurately positioning the sensor relative to the armature. Measurement can be carried out with a flat sensor against an elevated measuring point. It is, therefore, simple to supervise force characteristics of the armature such as during large scale industrial manufacturing.

Although other modifications and changes may be suggested by those skilled in the art, it is the intention of the inventors to embody within the patent warranted hereon all changes and modifications as reasonably and properly come within the scope of their contribution to the art.

We claim

1. An electromagnetic relay, comprising:

a coil having a coil core;

an angled yoke having a first leg coupled to a first end of said coil core;

a flat armature forming a working air gap with a second opposite end of said coil core;

said angled yoke having a second leg forming a bearing edge at a bearing axis for said flat armature;

a contact spring interacting with at least one cooperating contact element; and said armature having a first surface facing away from said coil core, a projection extending from said first armature surface, said projection having a surface tapering in a punctiform shape with a highest location forming a measuring point lying at a predetermined distance from said bearing axis of said armature.

2. An electromagnetic relay as claimed in claim 1, wherein said projection is formed by a rivet button.

3. An electromagnetic relay as claimed in claim 2, wherein said rivet button fastens said contact spring to said 4. An electromagnetic relay as claimed in claim 1, wherein said projection is coined from material of said armature.

5. An electromagnetic relay as claimed in claim 1, wherein said projection has a surface rounded in the form of a hemisphere.

6. An improved electromagnetic relay having a coil disposed about a coil core, the improvement comprising:

an armature having a first side facing away from an end of said coil core and a second side facing toward said coil core, said second side of said armature forming a working air gap with said coil core;

means for providing a bearing axis for said armature about which said armature pivots; and means for providing a force measuring location on said armature at a predetermined distance from said bearing axis, said location providing means including a raised point on said armature.

7. An improved electromagnetic relay as claimed in claim 6, wherein said location providing means is a projection extending from said first side of said armature.

8. An improved electromagnetic relay as claimed in claim 7, wherein said projection is provided by a rivet button on said armature.

9. An improved electromagnetic relay as claimed in claim 6, further comprising:

a spring having a first portion abutting said first side of said armature, said first portion of said spring including an opening;

a rivet button formed extending from said first side of said armature, said rivet button extending through said opening in said spring, a bead extending from said rivet button to secure said spring in place on said armature, and a measuring point formed on said rivet button as a highest point on said rivet button.

* * * * *